US008701227B2

(12) United States Patent
Rohr

(10) Patent No.: US 8,701,227 B2
(45) Date of Patent: Apr. 22, 2014

(54) MATTRESS WITH ATTACHMENT PANELS FOR REMOVABLE ATTACHMENT TO A MATTRESS SUPPORT

(75) Inventor: William Rohr, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 992 days.

(21) Appl. No.: 12/267,857

(22) Filed: Nov. 10, 2008

(65) Prior Publication Data

US 2010/0115697 A1 May 13, 2010

(51) Int. Cl.
*A47G 21/00* (2006.01)

(52) U.S. Cl.
USPC ..... 5/411; 5/482; 5/494; 5/498; 5/499

(58) Field of Classification Search
USPC ..... 5/411, 482, 494, 498, 499
See application file for complete search history.

(56) References Cited

U.S. PATENT DOCUMENTS 1,788,370 A * 1/1931 De Long et al. ..... 5/308
2,059,875 A * 11/1936 Katz ..... 297/283.1
2,661,486 A * 12/1953 Roher ..... 5/248
4,336,621 A 6/1982 Schwartz et al.
4,646,375 A * 3/1987 Parker ..... 5/498
4,653,131 A * 3/1987 Diehl ..... 5/494
4,726,083 A 2/1988 Hoshall
4,899,404 A 2/1990 Galumbeck
5,081,728 A * 1/1992 Skinner ..... 5/727
5,267,364 A * 12/1993 Volk ..... 5/713
5,367,729 A * 11/1994 Lazar et al. ..... 5/494
5,638,562 A * 6/1997 Masoncup ..... 5/493
6,088,858 A * 7/2000 Juster et al. ..... 5/737
6,233,764 B1 * 5/2001 Orr ..... 5/496
6,687,935 B2 * 2/2004 Reeder et al. ..... 5/691
6,889,396 B2 5/2005 Weinman
6,954,957 B2 * 10/2005 Metzger et al. ..... 5/706
7,047,579 B2 5/2006 Piana et al.
2004/0060113 A1 * 4/2004 Lantagne ..... 5/494
2008/0115270 A1 * 5/2008 McCarthy ..... 5/494
2009/0056030 A1 * 3/2009 Bolden ..... 5/713
2011/0005000 A1 * 1/2011 Rippe et al. ..... 5/737
2011/0131724 A1 * 6/2011 Marcangelo et al. ..... 5/498

* cited by examiner

*Primary Examiner* — William Kelleher
(74) *Attorney, Agent, or Firm* — Shook, Hardy & Bacon L.L.P.

(57) ABSTRACT

An adjustable bed is provided having a mattress, a mattress support, and an attachment panel for removably attaching the mattress to the mattress support. The attachment panel can be disposed along at least a portion of at least one side of the mattress and extends below a bottom surface of the mattress. The attachment panel is attached to an underside of the mattress support.

14 Claims, 3 Drawing Sheets

MATTRESS WITH ATTACHMENT PANELS FOR REMOVABLE ATTACHMENT TO A MATTRESS SUPPORT

BACKGROUND

Adjustable beds are a versatile alternative to conventional beds because they allow the user to position the bed according to various configurations. Typically, adjustable beds allow for at least the head and foot of the bed to be raised and lowered. To prevent the mattress from slipping off of the mattress support during articulation, various devices are currently used. Examples of such devices include mattress retainer bars, mattress clips, and retainer brackets. These devices are generally configured to secure a mattress to a mattress support at just a few locations, which can cause unnecessary stress on the mattress. Additionally, some of these devices do nothing to prevent bridging of the mattress when the head and foot of the mattress support are articulated and in many cases make it difficult to put a fitted sheet over the mattress.

SUMMARY

The invention is defined by the claims below. This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention relate to a bed comprising a mattress resting on top of a mattress support, wherein the mattress has a covering material disposed over at least a top surface of the mattress. At least one attachment panel is provided for removably attaching the mattress to the mattress support. The at least one attachment panel is disposed along at least a portion of at least one side of the mattress and extends below a bottom surface of the mattress. The attachment panel may be removably attachable to either the underside of the mattress support or to a portion of the covering material.

In another illustrative aspect, the present invention includes a bed comprising a mattress support and a mattress resting on top of the mattress support, wherein the mattress has a covering material disposed over the top and side surfaces of the mattress. A first side of a zipper fastening system is secured to at least a portion of the covering material along at least one side of the mattress. At least one attachment panel is secured to the mattress support and extending upward, having a second side of the zipper fastening system secured to an upper edge of the attachment panel for removably attaching the mattress to the mattress support.

According to a third illustrative aspect, the present invention includes a bed having a mattress resting on top of a mattress support, wherein the mattress has a covering material disposed over at least a top surface of the mattress. At least one attachment panel is attached to a portion of the covering material such that the attachment panel is disposed along a portion of the side of the mattress and extends to the underside of the mattress support. A first side of a hook and loop fastening system is fixably secured to a bottom edge of the attachment panel and a second side of the hook and loop fastening system is fixably secured to at least a portion of the underside of the mattress support. Accordingly, the mattress may be removably attached to the mattress support by mating the first and second sides of the hook and loop fastening system.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

Figure 1:
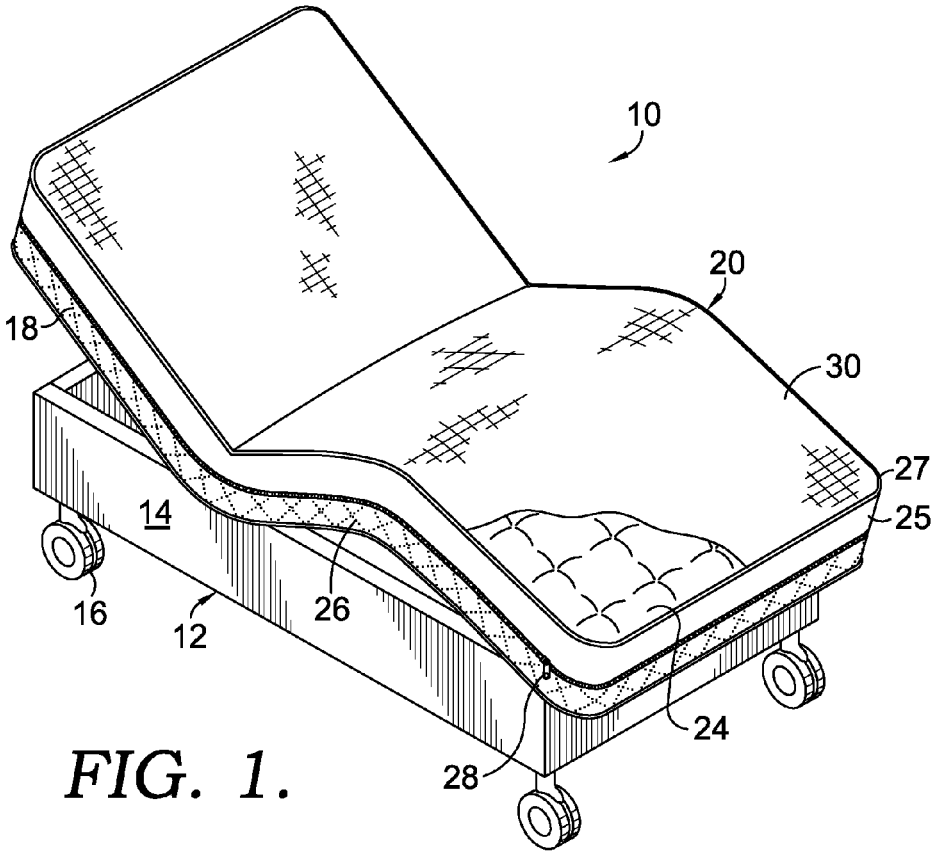
FIG. 1 is a perspective view, partially cut-away, showing an adjustable bed with a detachable mattress in accordance with an embodiment of the present invention.

Referring to the drawings, and particularly to FIG. 1, there is illustrated an adjustable bed 10 with an exemplary mattress attachment panel 26 in accordance with an embodiment of the present invention. The adjustable bed 10 includes a bed frame 12, a mattress support 18, and a mattress 20 secured to the mattress support 18 by an exemplary mattress attachment panel 26. The bed frame 12 includes a base 14 and may include casters 16.

According to the embodiment illustrated in FIG. 1, the mattress support 18 is disposed on top of the base 14. A mattress 20 is disposed over the top of the mattress support 18. The mattress 20 includes a mattress core 24 and a covering material 30 disposed over the mattress core 24. The mattress core can include various types of materials to provide comfort, including, for example, air bladders or foam. In another embodiment, the mattress core 24 includes a pillow top, a layer of laytex material, microcoils, and a layer of fibers. It should be understood that the materials in the mattress core 24 can be selected to achieve various levels of firmness of the mattress 20.

The covering material 30 can be disposed over any of the external surfaces of the mattress core 24. When disposed over the sides of the mattress, the covering material 30 may be referred to as a border panel, illustrated in FIG. 1 by reference numeral 25. The border panel 25 is fixably secured to the top portion of the covering material 30 along an upper peripheral edge by a taped edge border 27 and removably attached, along a lower peripheral edge, to an attachment panel 26 by way of a zipper fastening system 28. The attachment panel 26 is secured to the underside of the mattress support 18, and extends upward over the sides of the mattress support 18. Accordingly, the mattress 20 is removably attached to the mattress support 18.

Figure 2:
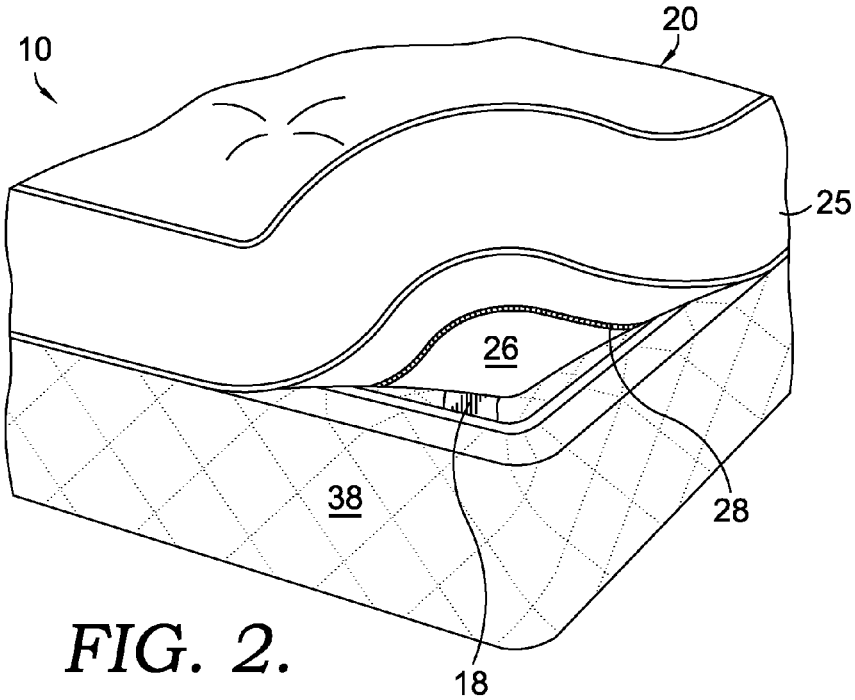
FIG. 2 is an enlarged perspective partial view of a corner of a bed in accordance with an embodiment of the present invention.

An alternative embodiment is illustrated in FIG. 2, which shows a partial perspective view of a corner section of an adjustable bed 12 in accordance with an embodiment of the present invention. A mattress 32 includes a border panel 34 that is removably secured to an attachment panel 36 by way of a zipper fastening system 42. The border panel, which in some embodiments may also be an upper portion of the attachment panel 42, interfaces with the attachment panel 42 (or the lower portion thereof) at a peripheral location somewhat underneath the mattress 32. In this manner, when the mattress 32 is laid flat against the mattress support 40, the zipper fastening system 42 is hidden from view behind a shroud 38. The shroud 38 may be constructed of wood, foam, or fabric and is provided around the outer peripheral edge of the mattress support 40 to provide an aesthetically pleasing appearance such as by simulating the appearance of a box spring of a conventional bed.

Figure 3:
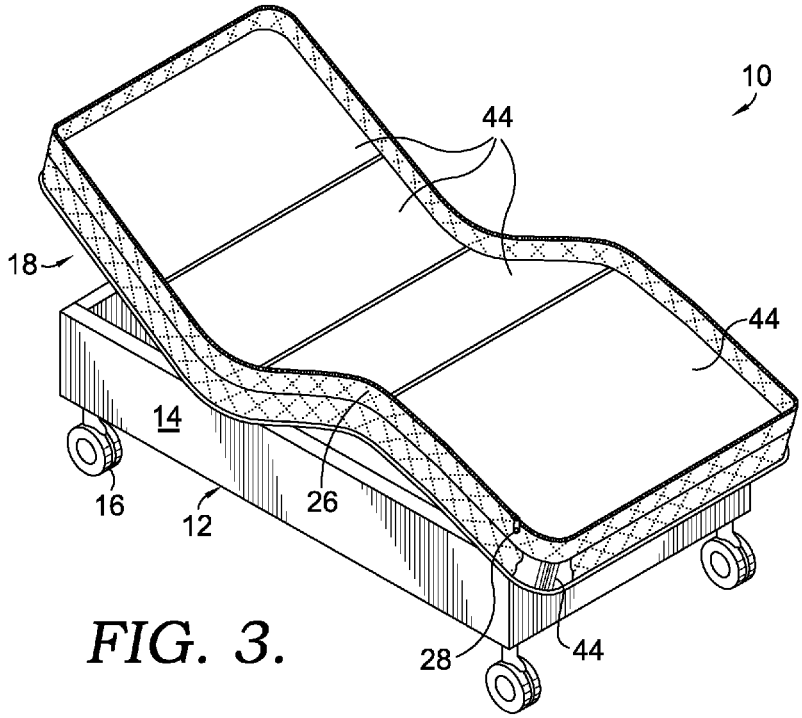
FIG. 3 is a perspective view of an adjustable bed with a zippered panel for attaching a mattress in accordance with an embodiment of the present invention.

Turning now to FIG. 3, there is illustrated another exemplary embodiment of the adjustable bed 10 of FIG. 1, wherein the mattress 20 has been removed from the mattress support 18. As illustrated, mattress support 18 includes a number of mattress support panels 44, at least one of which can move relative to at least one of the others so that different positions of the adjustable bed 10 can be achieved. As shown, the attachment panel 26, which is secured to the underside of some or all of the support panels 44, extends upward and includes a second side of a zipper 28 along an upper peripheral edge that is provided for removably attaching a mattress to the mattress support 18.

Figure 4:
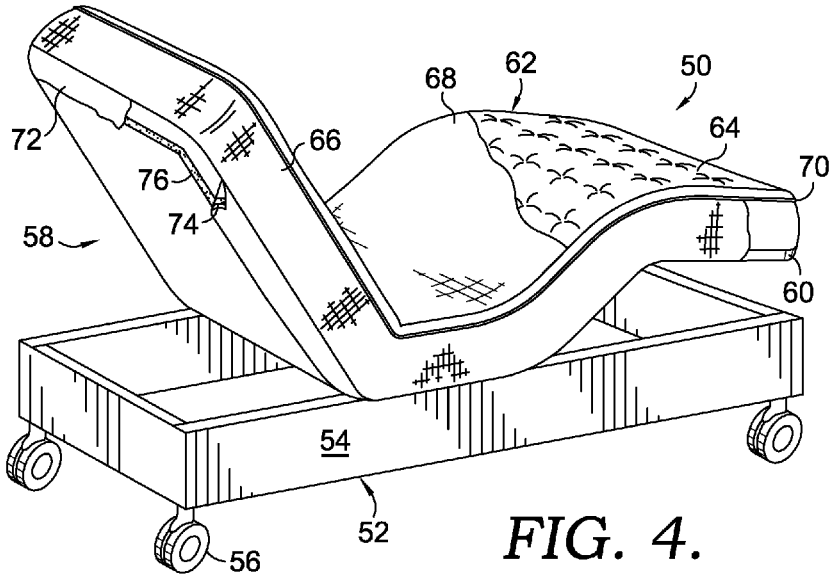
FIG. 4 is a perspective view, partially cut-away of an adjustable bed having a mattress attached with a hook and loop fastening system in accordance with an embodiment of the present invention.

Turning now to FIG. 4, an exemplary adjustable bed 50 is shown in accordance with an embodiment of the present invention. As illustrated, the adjustable bed 50 includes a bed frame 52, which includes a base 54 and casters 56. A mattress support 58 is disposed on the base 54 and includes one or more mattress support panels 60. As shown in FIG. 4, a mattress 62 is disposed on top of the mattress support 58 and includes a mattress core 64 encased in a covering material 68. The mattress 62 further includes a border panel 66 that is fixed to the covering material 68 by a tape edge border 70 extending peripherally along an upper edge of the border panel 66.

An attachment panel 72, which is, in the illustrated embodiment, contiguous with the border panel 66, extends below the bottom edge of the mattress 62, and wraps around the sides of the mattress support 58. The attachment panel 72 is removably secured to the underside of the mattress support 18 by way of a hook and loop fastening system 74, 76. One example of such a system is the Velcro® Hook and Loop Fastening System available from Velcro® of Manchester, N.H. A first side 74 of the hook and loop fastening system (i.e., either the hook portion or the loop portion) is peripherally secured to the inside edge of the attachment panel 72. In an embodiment, the first side 74 of the hook and loop fastening system is sewn to the attachment panel 72.

A second side 76 of the hook and loop fastening system is secured peripherally along the outside edge of the underside of the mattress support 58. In an embodiment, the second side 76 of the hook and loop fastening system is stapled to the underside of the mattress support 58. The mattress 62 is removably attached to the mattress support 58 by mating the first 74 and second 76 sides of the hook and loop fastening system such that the inside edge of the attachment panel 72 is secured to the underside of the mattress support 58. In an embodiment, the hook and loop fastening system 74, 76 is disposed along substantially the entire perimeter of the underside of the mattress support 58 and the inside edge of the attachment panel 72. Accordingly, the mattress 62 can be removably attached to the mattress support 58 in either of two general positions. The first position includes a first end of the mattress 62 being disposed above a first end (e.g., the head) of the mattress support 58. The second position includes the first end of the mattress 62 being disposed above a second end (e.g., the foot) of the mattress support 58. Accordingly, a mattress having mattress attachment panels according to embodiments of the present invention does not have to be placed on a mattress support in only one orientation. The mattress can be rotated such as, for example, to distribute wear on the mattress over time.

In an embodiment of the present invention, the first 74 and second 76 sides of the hook and loop attachment system are each at least three-quarters of an inch wide. In another embodiment such as when a lighter-weight mattress 50 is used, the widths of the first 74 and second 76 sides of the hook and loop fastening system can be approximately one quarter of an inch. Other widths, styles, and the like may be selected according to various embodiments to accommodate particular mattresses that can have varying degrees of firmness, flexibility, and ease of detachment.

Figure 5:
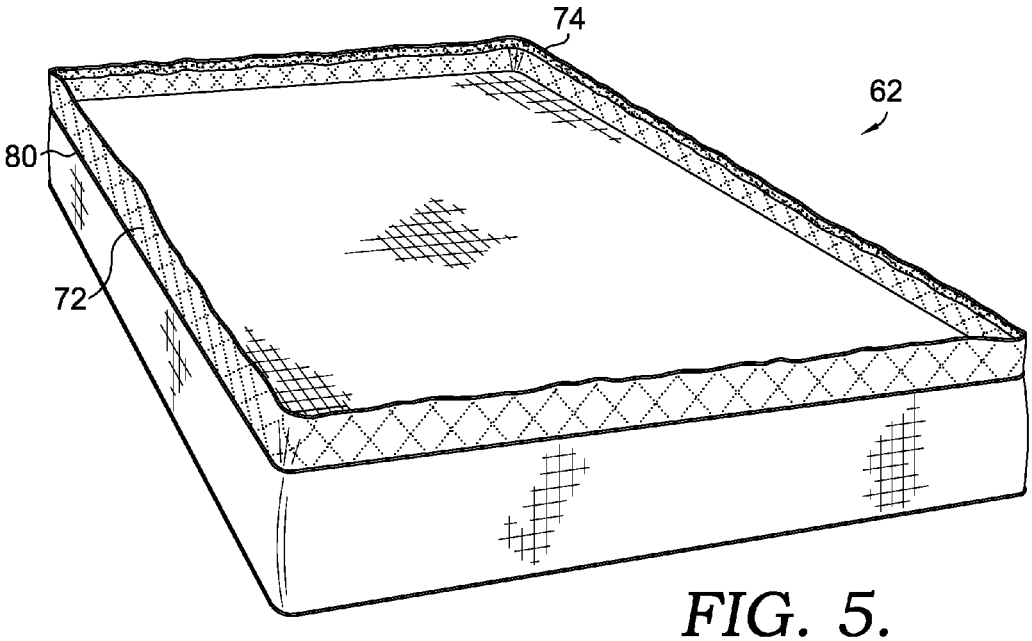
FIG. 5 is a perspective view of a mattress with an attachment panel in accordance with an embodiment of the present invention.

FIG. 5 shows an illustrative mattress 62 in an upside-down position such that an exemplary embodiment of the attachment panel 72 can be clearly illustrated. As shown in FIG. 5, a first side 74 of a hook and loop attachment system is secured to the underside of the peripheral edge of the attachment panel 72. The attachment panel 72 is sewn to a lower taped edge border 80 disposed around the lower peripheral edge of the mattress 62. Although the attachment panel 72 is shown to extend uniformly around the lower peripheral edge of the mattress 62, it should be understood that various alterations can be made to the attachment panel 72 to accommodate particular adjustable bed construction designs. For example, in an embodiment, the corners of the attachment panel 72 can be mitered such that when the first side 74 of the hook and loop fastening system is mated with a second side thereof disposed on the underside of a mattress support, the attachment panel 72 will lay flat against the edge of the mattress support and the sides of the mattress 62. Other manners of improving the aesthetics of the attachment panel 72 may be employed as well, such as cutting notches or other portions from the corners of the attachment panel 72.

Figure 6:
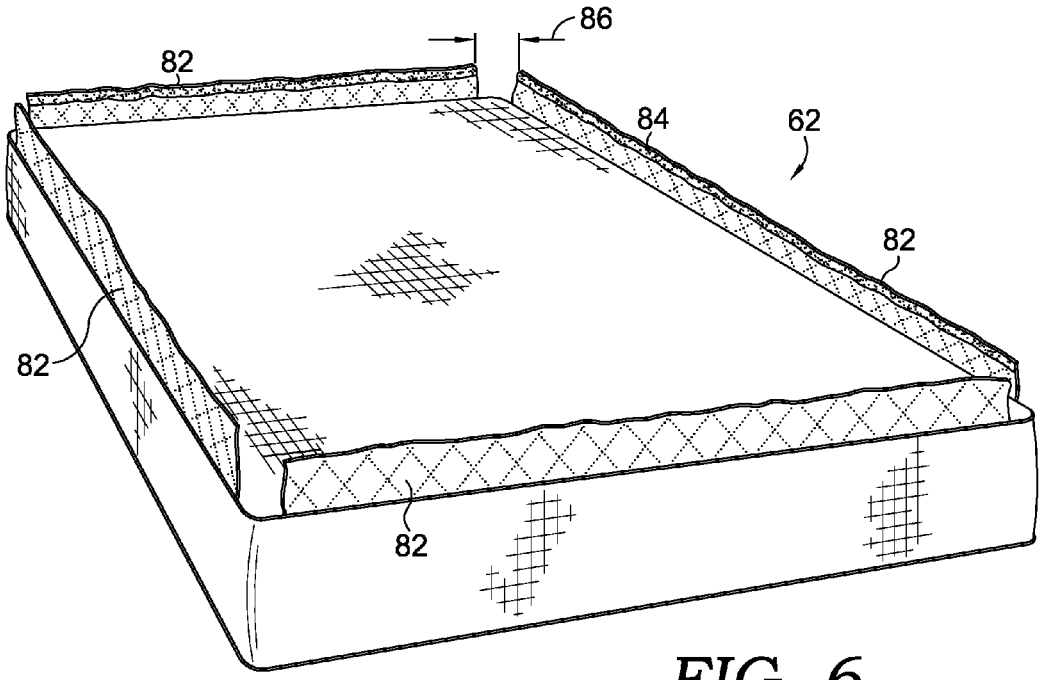
FIG. 6 is another perspective view of a mattress with an attachment panel in accordance with an embodiment of the present invention.

One further exemplary embodiment of the present invention is illustrated in FIG. 6, which shows a plurality of attachment panels 82 secured to a mattress 62 which is shown in an upside-down position. The attachment panels 82 each have a first side 84 of a hook and loop attachment system secured to the underside of the peripheral edge of the attachment panel 82, as described above with respect to FIGS. 4 and 5. There is also illustrated a gap 86 between each of the attachment panels 82. As shown in FIG. 6, each gap 86 is located at a corner of the mattress 62.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. An adjustable bed comprising:

a mattress support that comprises a plurality of support panels, at least one of said support panels movable relative to the other ones of said support panels to thereby adjust the bed;

a mattress resting on top of the mattress support, the mattress having 1) a covering material disposed over at least a top surface of the mattress to provide a top surface of the covering material, and 2) a covering material disposed over at least one side of the mattress to provide at least one border panel, wherein the top surface of the covering material is fixably secured to the at least one border panel along an upper peripheral edge of the at least one border panel; and a plurality of attachment panels for removably attaching the mattress to the mattress support, the plurality of attachment panels being disposed along a substantial portion of at least one side of the mattress and extending below a bottom surface of the mattress, wherein each of the plurality of attachment panels comprises a top edge and a bottom edge, wherein the plurality of attachment panels is removably attachable to an underside of the mattress support and the at least one border panel, wherein the underside of the mattress support is a bottom surface of the mattress support, wherein the top edge of the plurality of attachment panels is removably attachable to a lower peripheral edge of the at least one border panel, and further wherein the bottom edge of the plurality of attachment panels is removably attachable to the bottom surface of the mattress support, wherein a gap exists between attachment panels on adjacent sides of the mattress such that the plurality of attachment panels lay flat against the sides of the mattress when the attachment panels are secured to the underside of the mattress support, and further wherein each of the plurality of attachment panels begins at an underside of the mattress based on attaching a top edge of at least one of the plurality of attachment panels to a lower peripheral edge of the at least one border panel, the plurality of attachment panels constructed so that attaching of the plurality of attachment panels to the lower peripheral edge of the at least one border panel and the underside of the mattress support prevents the mattress from slipping off of the mattress support during articulation of the mattress support.

2. The bed of claim 1, wherein the covering material is disposed over the sides of the mattress.

3. The bed of claim 1, wherein the plurality of attachment panels are removably attachable to the covering material.

4. The bed of claim 1, wherein the plurality of attachment panels are removably attachable to the mattress support.

5. The bed of claim 3, wherein removably attaching the plurality of attachment panels to the covering material is achieved by mating one side of a zipper that is secured to an edge of the covering material with another side of the zipper that is secured to at least one attachment panel.

6. The bed of claim 4, wherein removably attaching the plurality of attachment panels to the mattress support is achieved by mating a first side of a hook and loop type fastening system with a second side of said hook and loop type fastening system, wherein the first side of said system is secured to the at least one attachment panel and the second side of said system is secured to the underside of the mattress support.

7. An adjustable bed comprising:

a mattress support that comprises a plurality of support panels, at least one of said support panels movable relative to the other ones of said support panels to thereby adjust the bed;

a mattress resting on top of the mattress support, the mattress having 1) a covering material disposed over at least a top surface of the mattress to provide a top surface of the covering material, and 2) a covering material disposed over at least one side of the mattress to provide at least one border panel, wherein the top surface of the covering material is fixably secured to the at least one border panel along an upper peripheral edge of the at least one border panel;

a plurality of attachment panels removably attached to a portion of the covering material disposed over the at least one side of the mattress such that each of the plurality of attachment panels is disposed along a substantial portion of at least one side of the mattress and extends to the underside of the mattress support, wherein the underside of the mattress support is a bottom surface of the mattress support oriented in a plane substantially parallel to the bottom surface of the mattress, wherein a gap exists between attachment panels on adjacent sides of the mattress, wherein each of the plurality of attachment panels comprises a top edge and a bottom edge, and further wherein each of the plurality of attachment panels begins at an underside of the mattress based on attaching the top edge of at least one of the plurality of attachment panels to a lower peripheral edge of the at least one border panel;

a first side of a hook and loop fastening system fixably secured to a bottom edge of each of the plurality of attachment panels; and a second side of the hook and loop fastening system fixably secured to at least a portion of the underside of the mattress support such that removably attaching the mattress to the mattress support is achieved by mating the first and second sides of the hook and loop fastening system, thereby fastening the bottom edge of each of the plurality of attachment panels to the underside of the mattress support the plurality of attachment panels constructed so that attaching of the plurality of attachment panels to the lower peripheral edge of the at least one border panel and the underside of the mattress support prevents the mattress from slipping off of the mattress support during articulation of the mattress support.

8. The bed of claim 7, further comprising an attachment panel disposed along each of the four sides of the mattress, each attachment panel having a first side of a hook and loop fastening system secured to a lower edge of the attachment panel.

9. The bed of claim 8, wherein the plurality of attachment panels extends along the entire perimeter of the mattress and further wherein a notch has been removed from each corner of the attachment panel such that the plurality of attachment panels lay flat against the sides of the mattress when the it is secured to the underside of the mattress support by mating the first and second sides of the hook and loop fastening system.

10. The bed of claim 8, wherein the second side of the hook and loop fastening system extends along each side of the bottom surface of the mattress support.

11. The bed of claim 8, wherein the covering material is disposed over the sides of the mattress.

12. The bed of claim 7, wherein one or more of said support panels has a second side of a hook and loop fastening system disposed along at least one edge of the bottom surface of the support panel.

13. The bed of claim 8, wherein the mattress comprises a pillow top mattress for use on an adjustable bed mattress support.

14. The bed of claim 8, wherein second side of the hook and loop fastening system is secured to the bottom surface of the mattress support by a plurality of staples.

* * * * *